US006216412B1

(12) United States Patent
Offersen

(10) Patent No.: US 6,216,412 B1
(45) Date of Patent: Apr. 17, 2001

(54) METHOD FOR THE REINFORCEMENT OF REINFORCED CONCRETE AND REINFORCEMENT FOR USE THEREOF

(75) Inventor: Kurt Offersen, Kerteminde (DK)

(73) Assignee: IB Andresen Industri A/S, Langeskoy (DK)

( * ) Notice: Subject to any disclaimer, the term of this patent is extended or adjusted under 35 U.S.C. 154(b) by 0 days.

(21) Appl. No.: 09/284,667

(22) PCT Filed: Sep. 26, 1997

(86) PCT No.: PCT/DK97/00409

§ 371 Date: Jun. 16, 1999

§ 102(e) Date: Jun. 16, 1999

(87) PCT Pub. No.: WO98/17879

PCT Pub. Date: Apr. 30, 1998

(30) Foreign Application Priority Data

Oct. 22, 1996 (DK) ..... 1165/96

(51) Int. Cl.[7] ..... E04C 5/16

(52) U.S. Cl. ..... 52/677; 52/414; 52/663; 52/668; 52/742.14; 249/30; 249/50

(58) Field of Search ..... 52/414, 668, 664, 52/663, 685, 677, 742.14; 249/30, 50

(56) References Cited

U.S. PATENT DOCUMENTS

| | | | |
|---|---|---|---|
| 1,835,806 | | 12/1931 | Olmsted et al. . |
| 4,073,112 | | 2/1978 | Leiblich et al. . |
| 5,664,378 | * | 9/1997 | Bettigole et al. ..... 52/414 |

FOREIGN PATENT DOCUMENTS

| | | |
|---|---|---|
| 057 344 A2 | 10/1981 | (EP) . |
| 2 691 996 A1 | 6/1992 | (FR) . |
| WO 96/30607 | 10/1997 | (WO) . |

* cited by examiner

*Primary Examiner*—Christopher T. Kent
(74) *Attorney, Agent, or Firm*—William J. Sapone; Coleman Sudol Sapone, P.C.

(57) ABSTRACT

The invention concerns a method for the reinforcement of a concrete beam, where the reinforcement comprises reinforcement rods which extend longitudinally and transversely and are locked at their mutual points of intersection. The invention consists of placing at least one reinforcement rod in an undercut corner in a cutout along outer sides of assembly frames disposed transversely to the reinforcement rods in that the assembly frames are two longitudinal girders and two transverse girders. A reinforcement rod may be locked with a spring shackle deformed for gripping around the reinforcement rod and one of the girders.

7 Claims, 3 Drawing Sheets

METHOD FOR THE REINFORCEMENT OF REINFORCED CONCRETE AND REINFORCEMENT FOR USE THEREOF

BACKGROUND

The present invention concerns a method for the reinforcement of concrete, especially the reinforcement of a concrete beam, where the reinforcement comprises reinforcement rods which extend longitudinally and transversely in several layers, where the layers of reinforcement rods are controlled at mutual distance by means of cutouts in the side of lists which are positioned transversely to the layers of reinforcement rods, and the reinforcement rods and the lists are connected at their mutual intersection points with a first spring shackle of a known type.

The invention also concerns a reinforcement for use in the execution of the method.

Concrete which is strengthened by the moulding-in of steel rods is known as reinforced concrete. Due to the reinforcement, reinforced-concrete constructions are not only able to withstand pressure but also traction, bending and twisting.

The reinforcement rods can be in the form of rib bars which have corrugations or ribs on the surface in order to be able to transfer the forces between reinforcement and concrete. In a horizontal reinforced-concrete beam which is simply supported at both ends and influenced by a downwardly-directed load, there is therefore provided a strong reinforcement, the main reinforcement, in the underside of the beam, which is exposed to tractive forces, while a weaker reinforcement, the assembly reinforcement, is provided in the upper side of the beam.

Both the main reinforcement and the assembly reinforcement consist of reinforcement rods which, depending on the dimensions of the beam, extend in a parallel manner at a mutual distance, and both reinforcements are further connected with loops of thinner reinforcement rods, so that the overall reinforcement constitutes a cage in which the positioning of the rods at their mutual intersections is ensured by binding with steel wire. Such a reinforcement cage is lowered into the shuttering, or the shuttering is built up around the reinforcement cage, after which the reinforcement is cast in concrete.

The binding with wire is carried out because it is extremely important that the reinforcement rods lie placed with very small tolerances inside the finished beam. Two reinforcement rods, which cross each other, shall thus be placed within a distance of 5 mm, but since the ribs on the reinforcement rods are 2 mm, two reinforcement rods which rest on the ribs are already 4 mm from each other, so the tolerance for the positioning is hereby down to 1 mm.

With the known reinforcement technique, this requires that the mutual positioning of the reinforcement rods must be carefully controlled prior to each individual binding, which also in itself requires considerable effort. Consequently, the mounting of the reinforcement rods is time-consuming and herewith costly.

A reinforcing of concrete substantially of the above-mentioned kind is known from U.S. Pat. No. 1,835,806. The publication deals with a reinforcement in a road plate of concrete, where the lists with their one end abut against the underlayer, and where there are shown two parallel, horizontal layers of reinforcement rods which cross one another in each layer.

In the one side of the lists there are cutouts, in that in the formation of the uppermost cutout there is made a simple vertical cut, after which the web formed hereby is bent at right-angles in relation to the plane of the lists as support for a reinforcement rod, which extends at right-angles to the plane of the lists. For further support of the reinforcement rod, the outer side of the web is bent slightly upwards in the formation of a bed for the reinforcement rod. A lower-lying cutout is provided in a corresponding manner.

A layer of reinforcement rods, which extends transversely to the plane of the lists, is placed in the cutouts, after which the layer of reinforcement rods extending longitudinally is positioned underneath the first layer abutting against the underside of the above-mentioned webs and secured by means of spring shackles.

Each of the spring shackles has a short and a long leg, each leg extending up from an arc which lies up against the underside of a longitudinal reinforcement rod around a transverse reinforcement rod in a cutout. The short leg is disposed on that side of the list where the cutout's web protrudes, and the short leg ends here. The long leg extends further on the opposite side of the list, i.e. on that side facing away from the web, and is fixed by being crossed under the longitudinally-extending reinforcement rod where it is held in a fixed manner by means of a hook on the end, said hook lying up against the longitudinally-extending reinforcement rod.

The known spring shackle thus has two different legs; a short leg and a long leg.

From U.S. Pat. No. 4,073,112 there is known a reinforcing system for use in a reinforced concrete construction. The means in this reinforcement consist of reinforcement rods and lists which have cutouts for the engagement of the reinforcement rods along an outer side. The function of the lists is to form a frame, where a reinforcement rod can be placed in a corner in a cutout in the formation of the overall reinforcement.

None of these publications disclose a technique which is suitable for reinforcing a reinforced-concrete beam, where a particularly accurate positioning of the reinforcement rods must take place both in relation to each other and to the surface of the finished concrete beam. Moreover, the known spring shackles are not of a configuration which makes them usable in such reinforcement.

SUMMARY OF THE INVENTION

It is the object of the present invention to provide a method whereby an extremely accurate positioning of the reinforcement rods is achieved in a reinforced-concrete beam, without any time-consuming and costly measuring of the mutual positioning, and without the otherwise necessary binding with wire respectively, where the spring shackles permit a quick and secure fastening of the reinforcement rods in their correct position.

This object is achieved with a method of the kind disclosed in the preamble, said method according to the invention being characterized in that the reinforcement rods in the one layer of reinforcement rods in a number of at least one reinforcement rod is placed in an undercut corner in rectangular cutouts which are formed along the outerside of assembly frames, said frames comprising two longitudinal girders and two transverse girders, and in that the two legs of said spring shackles extend in the plane of the girders, and the ends of the legs being formed as hooks which extend substantially out from said plane.

When the reinforcement rods are placed in an undercut corner in a cutout on the assembly frames, their positioning is safely determined in that the first spring shackle positively ensures the engagement of each individual reinforcement rod in the corner, and the placing of this spring shackle is far quicker than a troublesome and time-consuming binding with wire, in that the first spring shackle must merely be deformed for a brief period and thereafter grips permanently around the girder provided with the cutout.

The assembly frames can serve as an element in the reinforcement, which offers a further financial advantage.

The invention also concerns a reinforcement for use in the execution of the method, and of that kind where the reinforcement comprises reinforcement rods which extend longitudinally and transversely in several parallel layers, where the layers of reinforcement rods are controlled at mutual distances by means of cutouts in the side of lists which are placed transversely to the layers of reinforcement rods, and the reinforcement rods and the lists are connected at their mutual intersection points with a first and commonly-known spring shackle, said reinforcement according to the invention being characterized in that the reinforcement comprises assembly frames which have two longitudinal girders and two transverse girders, said girders along the outerside of the assembly frames having a number of rectangular cutouts which are arranged in undercut corners to accommodate at least one reinforcement rod, and spring shackles which are configured, upon being deformed, to grip around this one reinforcement rod and one of the girders, in that the two legs of said spring shackle extend in the plane of the girder, and the ends of the legs are formed as hooks which extend substantially out from said plane.

The associated claims respectively disclose advantageous ways in which to proceed and advantageous configurations of the reinforcement according to the invention.

BRIEF DESCRIPTION OF THE DRAWINGS

The method and the reinforcement according to the invention will now be described in more detail with reference to an example embodiment which is shown in the drawing, where.

DETAILED DESCRIPTION OF THE INVENTION

Figure 1:
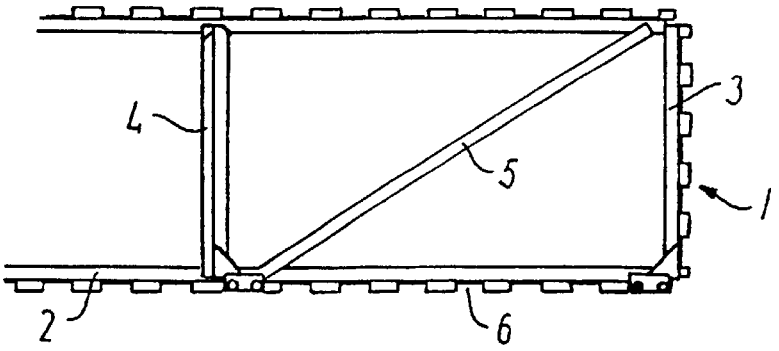
FIG. 1 shows an end of the assembly frame according to the invention.

In FIG. 1 is shown an end of an assembly frame 1 according to the invention. The assembly frame 1 has two longitudinal girders 2 and two transverse girders 3. Between the two longitudinal girders 2 there is shown a single brace 4, and it will be understood that there can be several internal braces 4 between the longitudinal girders 2, along and depending on the length of the assembly frame 1. There can also be angle braces 5 as required. The dimensions of the longitudinal girders 2 and the transverse girders 3 will naturally depend on the concrete beam to be reinforced.

Figure 2:
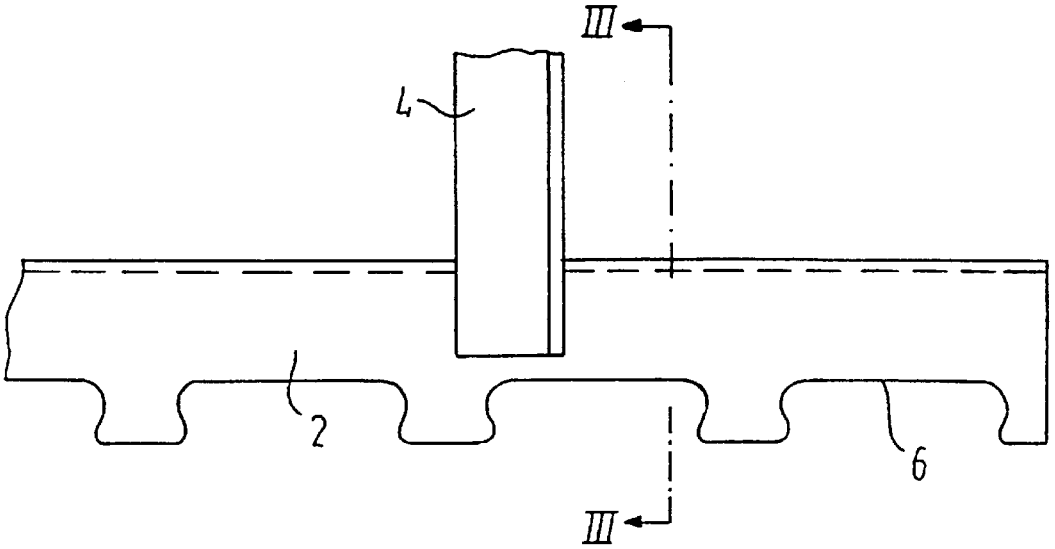
FIG. 2 shows a section from an assembly frame according to the invention.
Figure 3:
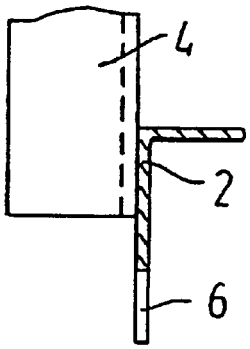
FIG. 3 shows the section indicated with the arrows III—III in FIG. 2.
Figure 4:
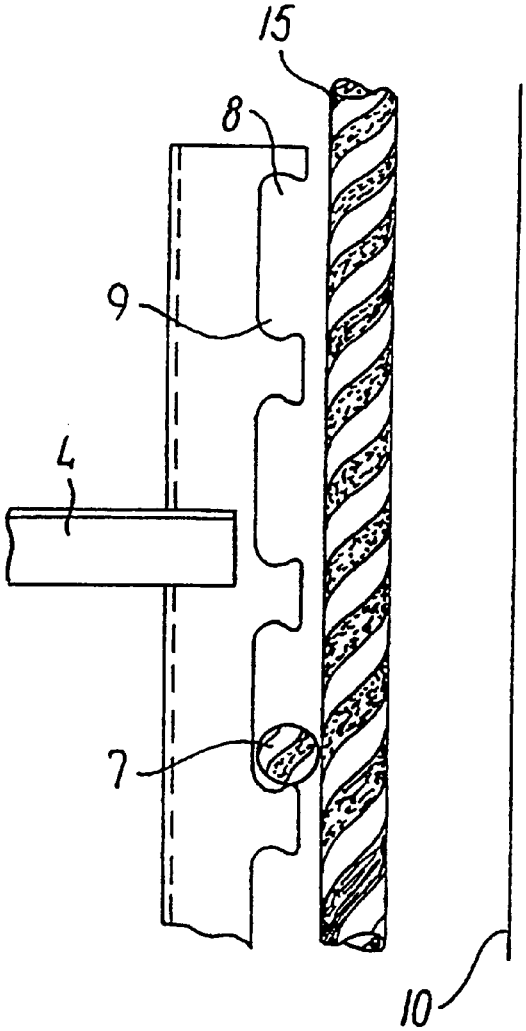
FIG. 4 shows the section in FIG. 2 in another position and with two reinforcement rods which respectively extend transversely and longitudinally to the plane of the assembly frame.

The longitudinal girders 2 and the transverse girders 3 preferably consist of angle-iron, as will be deduced from FIG. 2–4, and are mutually assembled with the braces 4 by welding. The longitudinal girders 2 and the transverse girders 3 are provided along the outer edge with cutouts 6, each of which is arranged in a corner to be able to accommodate at least one reinforcement rod 7 (see FIG. 4) which extends transversely to the plane of the assembly frame 1, whereby the reinforcement rods 7 are correctly placed in relation to the surface 10 of the finished reinforced-concrete beam.

The cutouts 6 are preferably wide enough to be able to accommodate two reinforcement rods 7, in which case they are placed in the opposite corners 8, 9. These corners 8, 9 are preferably undercut and, in accordance with the reinforcement rods 7, are suitably dimensioned and at a suitable distance from one another, so that two reinforcement rods placed in these corners assume precisely the correct mutual distance and positioning in relation to the surface 10 of the finished reinforced-concrete beam.

The cutouts 6 are produced in any known manner, such as blanking, flame cutting or laserbeam burning.

Figure 5:
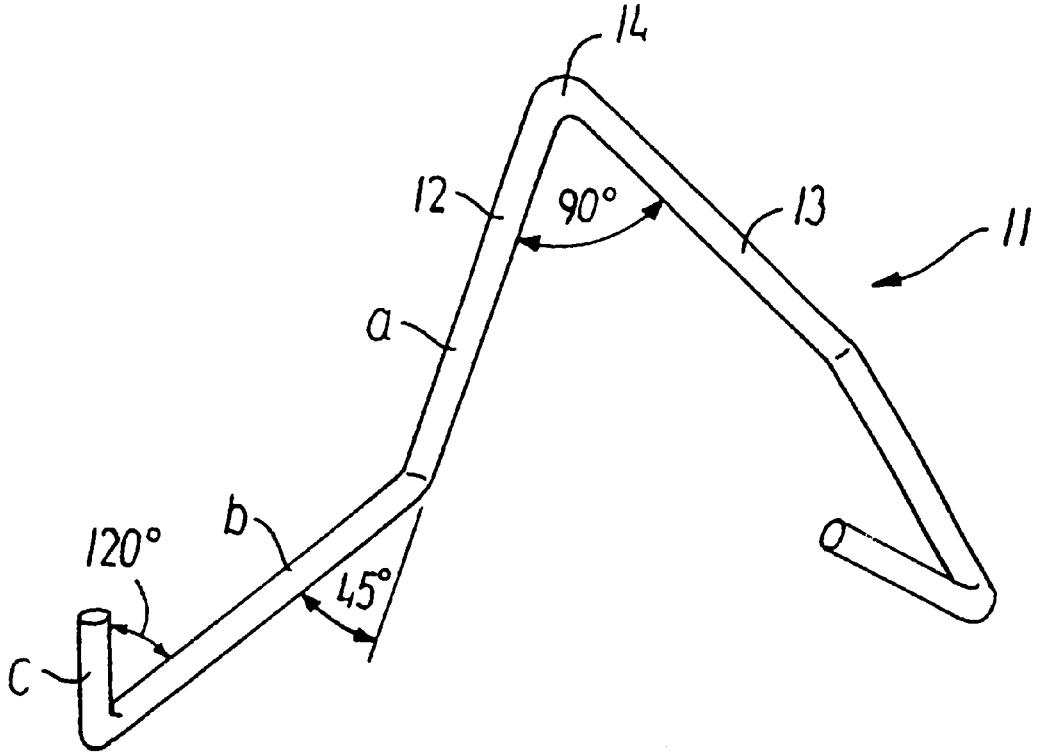
FIG. 5 is a perspective view of a first spring hackle which in itself is known.

In FIG. 5, a first spring shackle 11 of known type is shown in perspective. The first spring shackle 11 has two legs 12, 13 which are symmetrical around a plane through the centre 14 of the spring shackle 11, in that the legs have a mutual angle which is preferably 90°. Each leg has a first straight piece a, after which through a first bend of less than 45°the legs extend in a second piece b to a hook c which is formed by a second bending of slightly less than 120°. The pieces a thus lie in one and the same first plane, the pieces b lie in one and the same second plane which slopes in relation to the first plane, and the hooks c similarly lie in one and the same third plane which extends more or less at right-angles to the second plane.

However, the precise angles between the legs' 12, 13 individual parts a and b and the hooks c and the mutual angles of the three planes are not decisive, but are shown only as examples of the configuration of the first spring shackle 11.

The first spring shackle 11 is arranged to be able to be placed with the centre 14 riding over a reinforcement rod 7, with the hooks c gripping around opposite edges of a cutout 6 in a longitudinal girder 2 or transverse girder 3. This is done by squeezing the legs 12, 13 towards each other, hereby reducing the angle at the centre 14 of the spring shackle 11, and at the same time straightening out the legs' second straight piece b so that it comes to lie more or less in extension of the first straight piece a, so that the hooks c can grip around the edge of a cutout 6 in a longitudinal or transverse girder, after which the spring shackle 11 is allowed to spring back again.

After the placing of the reinforcement rods 7 transversely to the plane of the assembly frame 1, and ensuring their correct position in the cutouts 6 by means of the first spring shackle 11, the reinforcement rods 15 are then placed extending transversely to the reinforcement rods 7 as shown in FIG. 4.

Figure 6:
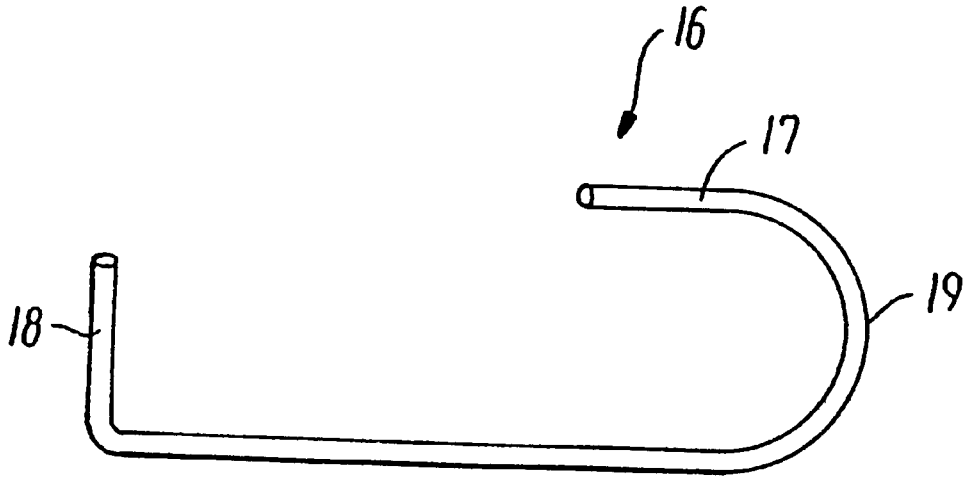
FIG. 6 is a perspective view of a second spring hackle.

These reinforcement rods 15 must also be secured in the correct position in relation to the first-placed reinforcement rods 7, which is done by means of the spring shackles 16 shown in FIG. 6, where the hook 17 on the one leg extends in a plane which stands at right-angles to the plane of the hook 18 on the other leg in such a manner that the one hook 17 can grip around the reinforcement rod 15, and the other hook 18 can grip around an edge opposite a cutout 6 in a longitudinal girder 2 or a transverse girder 3.

As indicated by the designation, both of the spring shackles 11, 16 are made of spring wire, and a tool is available which can deliver the force necessary for deformation during the placing around the reinforcement rods 7, and the longitudinal and/or transverse girders 2, 3.

The reinforcement according to the invention offers a further advantage, particularly in connection with casting in several stages, which requires a controlled temperature difference between the hardened concrete and the concrete currently being cast. It is therefore practice to insert both cooling and heating pipes in the shuttering for the respective cooling/heating of the concrete mass, said pipes thereafter being allowed to remain in the finished concrete.

Here, the assembly frame or frames 1 constitute a rigid framework which is suitable for supporting sections which are provided with the necessary pipes.

What is claimed is:

1. A method for reinforcement of concrete by a plurality of reinforcement rods which extend longitudinally and transversely in several parallel layers, the layers of reinforcement rods being held at a mutual distance by lists having cutouts in sides thereof, the lists disposed transversely to the layers of reinforcement rods, the reinforcement rods and the lists being fixed at the mutual intersection points thereof, the method for reinforcement comprising:

providing at least one assembly frame formed by two longitudinal girders and two transverse girders; and, placing at least one reinforcement rod in a layer of reinforcement rods in an undercut corner located in at least one of a plurality of rectangular cutouts formed along outer sides of the at least one assembly frame.

2. A reinforcement for a concrete structure comprising:

a plurality of reinforcement rods which extend longitudinally and transversely in several parallel layers, the layers of reinforcement rods being held at a mutual distance by lists having cutouts in sides thereof which receive the rods therein, the lists located transversely to the layers of reinforcement rods, the reinforcement rods and lists being fixed at the mutual intersection points thereof, assembly frames each having two longitudinal girders and two transverse girders, said girders along outer sides of the assembly frames having a plurality of rectangular cutouts, the cutouts having undercut corners for receiving at least one reinforcement rod therein.

3. The reinforcement of claim 2 wherein the cutouts are arranged to accommodate two reinforcement rods therein, each reinforcement rod disposed in an opposite corner thereof.

4. The reinforcement of claim 2 wherein the undercut corners have a size corresponding to a size of the reinforcement rods, the undercut corners being mutually spaced apart so that two reinforcement rods placed in the undercut corners have a predetermined mutual distance therebetween for predetermined positioning in relation to a surface of the reinforced concrete.

5. The reinforcement of claim 2 wherein the assembly frames further comprise internal braces.

6. The reinforcement of claim 2 wherein the assembly frames further comprise diagonal braces.

7. The reinforcement of claim 2 wherein the concrete structure is a concrete beam.

* * * * *